US006836969B1

(12) United States Patent
Bates

(10) Patent No.: US 6,836,969 B1
(45) Date of Patent: Jan. 4, 2005

(54) SLIDING GAUGE FOR MAKING MEASURED MARKINGS

(76) Inventor: Randy N. Bates, 534 Bengson Ct., Round Lake Park, IL (US) 60073

( * ) Notice: Subject to any disclaimer, the term of this patent is extended or adjusted under 35 U.S.C. 154(b) by 0 days.

(21) Appl. No.: 10/464,325

(22) Filed: Jun. 18, 2003

(51) Int. Cl.[7] ..... B43L 13/02
(52) U.S. Cl. ..... 33/42; 33/809; 33/464
(58) Field of Search ..... 33/32.1, 32.2, 33/41.1, 42, 464, 489, 492, 646, 647, 648, 649, 809

(56) References Cited

U.S. PATENT DOCUMENTS

| | | | | | |
|---|---|---|---|---|---|
| 848,399 | A | * | 3/1907 | Rowell | 33/42 |
| 1,488,482 | A | * | 4/1924 | Eckman | 33/809 |
| 1,877,341 | A | * | 9/1932 | Kurtz, Jr. | 33/492 |
| 2,336,393 | A | * | 12/1943 | Combes | 33/809 |
| 2,470,035 | A | * | 5/1949 | Hudkins | 33/42 |
| 3,017,701 | A | | 1/1962 | Jernigan | |
| 3,805,390 | A | * | 4/1974 | Craig | 33/494 |
| 4,060,902 | A | | 12/1977 | Keller | |
| 4,338,056 | A | | 7/1982 | Abrahamson | |
| 4,477,980 | A | | 10/1984 | Jukes | |
| 4,503,624 | A | * | 3/1985 | Whiteford | 33/42 |
| 4,573,276 | A | | 3/1986 | Torczon | |
| 4,599,804 | A | | 7/1986 | Amos | |
| 4,662,077 | A | | 5/1987 | Richardson | |
| 4,930,221 | A | * | 6/1990 | Taylor | 33/42 |
| 4,995,167 | A | | 2/1991 | Sanchez | |
| 5,038,483 | A | * | 8/1991 | Witek | 33/42 |
| 5,404,651 | A | | 4/1995 | Brodrick | |
| 5,421,093 | A | * | 6/1995 | Davidson, Jr. | 33/42 |
| 5,692,311 | A | * | 12/1997 | Paquin | 33/647 |
| 6,036,133 | A | | 3/2000 | Milligan | |
| 6,049,990 | A | * | 4/2000 | Holland | 33/464 |
| 6,134,797 | A | * | 10/2000 | Boyce | 33/464 |
| 6,334,259 | B1 | * | 1/2002 | Harvey | 33/42 |
| 2001/0020334 | A1 | * | 9/2001 | Wrobbel | 33/42 |

* cited by examiner

*Primary Examiner*—G. Bradley Bennett
(74) *Attorney, Agent, or Firm*—Meroni & Meroni, P.C.; Charles F. Meroni, Jr.

(57) ABSTRACT

A hand held device for making measured markings. The device comprises a body having a bottom and a side surface with a butting surface connected to the body having a flat face perpendicular to the body to slidably butt against an edge of a work piece. A plurality of spaced guiding wells adjacent the side surface may receive a marking instrument point. The guiding wells simultaneously provide measurement and guidance for the marking instrument while the butting surface is slid along the edge of a work piece. A telescoping member having a flat top edge provides adjustable guidance for marking instrument as well. Reference markings on the telescoping member mark distance from the edge of the telescoping member to the butting surface. A fixing means may adjustably fix the relationship between the telescoping member and the body. The telescoping member is extendable to distance shown by the reference markings.

10 Claims, 4 Drawing Sheets

SLIDING GAUGE FOR MAKING MEASURED MARKINGS

BACKGROUND OF THE INVENTION

1. Field of the Invention

The present invention generally relates to gauges. More specifically, the present invention relates to gauges for making measured markings on a work piece.

2. Description of the Prior Art

There has been many different types of measuring hand tools developed for the construction industry over the years with little substantive change to the functionality of the hand tools. Several of these tools are discussed here.

U.S. Pat. No. 4,060,902 issued to Keller discloses a combination straight edge, T-square, level, ruler and guide is provided for use by craftsman such as paperhangers, carpenters, and the like. The tool includes a relatively wide elongated body formed with parallel straight edges along both long edges, a handle and a plurality of replaceable bubble vials for establishing vertical and horizontal lines.

U.S. Pat. No. 4,477,980 issued to Jukes discloses an alignment strut for use in constructing prefabricated walls. The strut has an interior pocket accommodating a lumber two by four which serves as a splice bar between adjacent struts and as a brace anchor point.

U.S. Pat. No. 4,573,276 issued to Torczon discloses a tool guide for directing hand tools over a workpiece at an angle perpendicular to one edge of the workpiece. The guide had two perpendicular legs equipped with flanges for aligning the guide and directing a hand tool along the guide.

U.S. Pat. No. 4,599,804 issued to Amos discloses an improved bricklayer's guide. The guide consists of a combination of notched posts or standards that will cooperate in providing the desired width and a series of notches on one post to provide the desired adjustment and secure the guide in place.

U.S. Pat. No. 4,662,077 issued to Richardson discloses a combination tool useful to a variety of building trades in building erection. The tool can be used as a story pole, a surveyor's rod, an extensible measuring device, a plumb and a horizontal level. When the tool id used as a measuring device, story pole or surveyor's grade rod, the tool of the present invention provides direct read capabilities eliminating the need for computations which in turn prevents errors in arithmetic commonly made when using tools of the prior art.

U.S. Pat. No. 5,692,311 issued to Paquin discloses a Sideboard Clamp and Jig Apparatus having a spring loaded clamp holding an L-shaped jig.

U.S. Pat. No. 6,036,133 issued to Milligan discloses an apparatus for aligning and positioning a mason's string. The apparatus comprises a housing for the line blocks having a spring-loaded reel assembly around which the string is coiled.

The prior art discloses devices that allow the location of a point on the face of a work piece with reference to the edge of the work piece but do not disclose a device that allows the user to simultaneously locate a point on the face of a work piece and also provide a guide for marking a line on the face of the work piece that is parallel to the edge of the work piece. Therefore, there is a need for a device that allows the location of a point on the face of a work piece while providing a guide for marking a line along the face of a work piece, thus simplifying the process of producing a parallel line on the face of a work piece that is at a measured distance from the edge of the work piece.

SUMMARY OF THE INVENTION

To fulfill the need for a device that allows the location of a point on the face of a work piece while providing a guide for marking a line along the face of a work piece, as well as other needs that will become apparent after reading this specification and viewing the appended drawings, the claimed invention provides a sliding gauge for making measured markings.

An objective of the claimed invention is to provide a hand held gauge that is capable of being slid along the edge of a work piece while guiding a marking instrument along the surface of the work piece at a measured distance from the edge of the work piece.

Another objective of the claimed invention is to provide a sliding gauge having a telescoping member that may be used to increase the amount of measuring capability while reducing the overall storage length of the gauge.

Another objective of the claimed invention is to provide a sliding gauge that simplifies the process of measuring and marking a line parallel to the edge of the work piece by providing a gauge that allow a user to locate and mark a desired line in one step.

The invention provides a sliding gauge for making measured markings on a work piece. The gauge generally comprises an elongated body, a telescoping member, a threaded fastener securing the telescoping member to the body by a knob, a pair of butt legs for sliding against an edge of a work piece, and a plurality of instrument stops.

The elongated body is preferably made of rigid plastic and is rectangular in shape. A centrally located slot through the body allows the shaft of the threaded fastener to slide within the slot. Each of the butt legs have a flat front face for placement against an edge of a work piece allowing the measurements made by the gauge to be made with reference to the edge of the work piece. The telescoping member, preferably T shaped and made of rigid plastic, has an aperture for receiving the threaded fastener. The back side of the telescoping member has a six sided retaining wall about the aperture designed to retain the head of the fastener. The telescoping member has a plurality of reference markings on the top surface referencing the distance from the front face of the butting legs to the top edge of the telescoping member. The shaft of the threaded fastener fits through the aperture within the telescoping member and the elongated slot of the body where the knob is fastened onto the end of the fastener. The multifaceted knob provides gripping surfaces for a user of the device to use when fixing the relationship between the telescoping member and the body.

The guiding wells allow a user of the device to place the tip of a marking instrument such as a pencil or pen into a well at a measured distance from the front face of the butt legs. The user of the gauge may butt the butt legs against the edge of a work piece and slide the gauge along the work piece with the tip of the marking instrument within the guiding wells to make a measured marking parallel to the edge of the work piece.

BRIEF DESCRIPTION OF THE DRAWINGS

FIG. 1 shows a perspective view of the gauge.

FIG. 2 shows a top view of the gauge.

FIG. 3 shows a side view of the gauge.

FIG. 4 shows a bottom view of the gauge.

FIG. 5 shows a top view of the gauge with the telescoping member extended.

FIG. 6 shows a side view of the gauge with the telescoping member extended.

FIG. 7 shows a bottom view of the gauge with the telescoping member extended.

FIG. 8 shows a top view of the gauge while in use.

FIG. 9 shows a top view of the gauge with the telescoping member extended while in use.

FIG. 10 shows the gauge being used in hanging siding on the side of a building.

DETAILED DESCRIPTION OF THE PREFERRED EMBODIMENT

Figure 1:
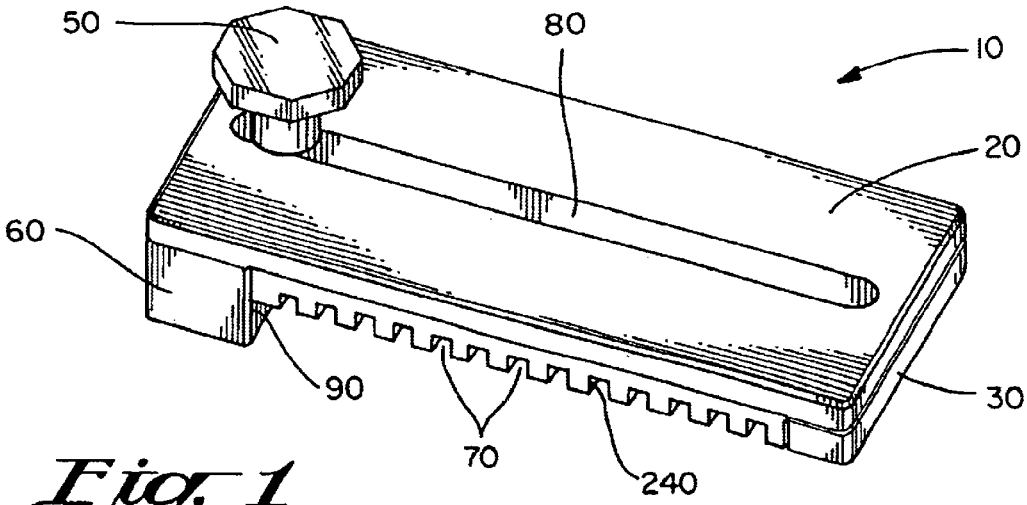
FIG. 1.

Turning now to the drawings, the preferred embodiment of the sliding gauge for making measured markings is shown in FIGS. 1–10. The gauge 10 generally comprises an elongated body 20, a telescoping member 30, a threaded fastener 40 securing the telescoping member 30 to the body 20 by a knob 50, a pair of butt legs 60 for sliding against an edge of a work piece, and a plurality of guiding wells 70.

The elongated body or frame 20 as shown through out the Figures is preferably made of rigid plastic and is rectangular in shape having a width of about 2 inches, a length of about 5 inches, and a thickness of about ¼ inch. These dimensions were chosen by Applicant so as to provide an easily used and stored gauge. However, it is contemplated as being within the scope of invention that the device can be made on a larger or smaller scale and still achieve the same results. The elongated body 20 has a centrally located elongated slot type aperture 80 through the body 20 so that the telescoping member 30 can be adjustably tightened against the body 20. The elongated slot 80 is preferably ¼ inch in width and preferably about 4½ inches long.

Figure 8:
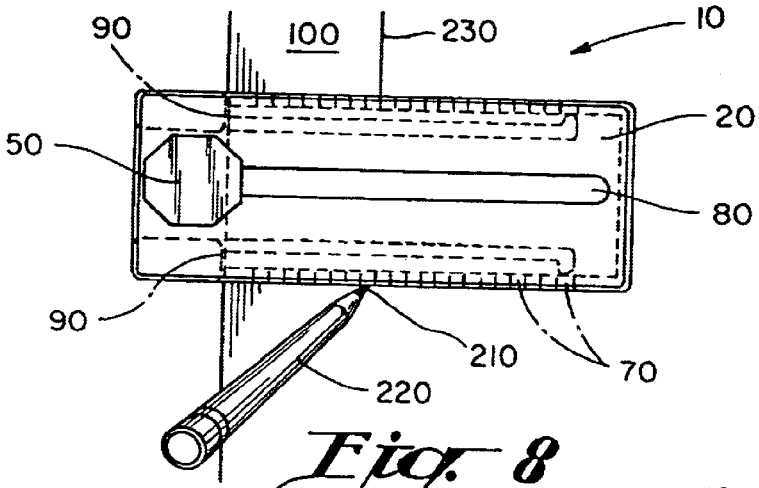
FIG. 8.
Figure 9:
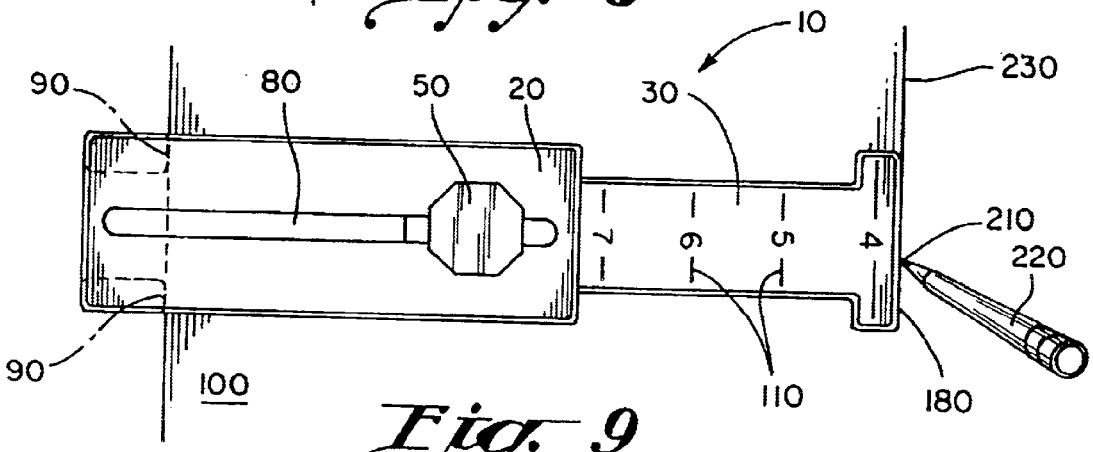
FIG. 9.

The butt legs 60 as shown in FIGS. 1, 3, 4, and 6 are preferably ¾ inch in height, 1 inch in width and ⅜ inch in thickness. Each of the butt legs 60 have a flat front face 90 for placement against an edge of a work piece. During use, the butt legs are butted against the edge of a work piece 100 as shown in FIGS. 8 and 9. This allows the measurements made by the gauge 10 to be made with reference to the edge of the work piece 100. The guide wells 70 and measurement marking 110 are made in reference to the front face 90 of the butt legs 60. Therefore, when the butt legs 60 are placed against the edge of a work piece 100 the measurements are being made with reference to the edge of the work piece 100.

The telescoping or moveable member 30 as shown in FIGS. 4–7 is preferably T shaped and made of rigid plastic having a minor width 120 of 1¼ inches, a major width 130 of 2 inches, and a length of 5 inches. An aperture 140, preferably having a diameter of ¼ inch is used to receive the threaded fastener. The back side 150 of the telescoping member 30 has a six sided retaining wall 160 about the aperture 140 designed to retain the head 170 of the fastener 40. The telescoping member 30 has a plurality of reference or measurement markings 110 on the top surface referencing the distance from the front face 90 of the butting legs 60 to the top edge 180 of the telescoping member 30 so that a user of the device 10 can adjust the relationship between the telescoping member 30 and the body 20 to measure a predetermined distance form the edge of a work piece to the top edge 180 where a marking can be placed.

Figure 4:
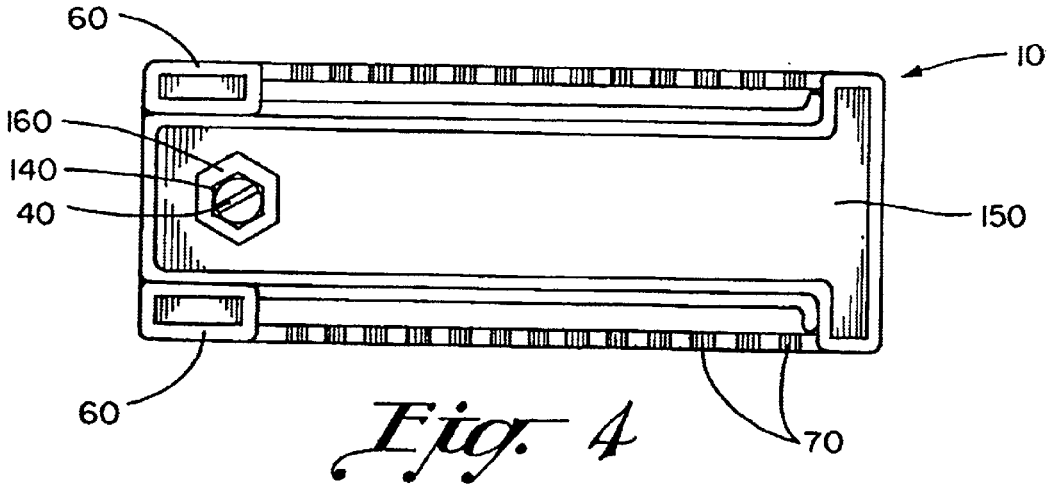
FIG. 4.
Figure 5:
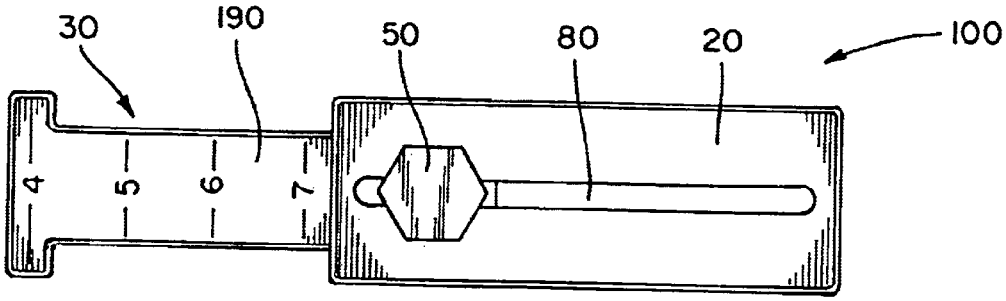
FIG. 5.
Figure 6:
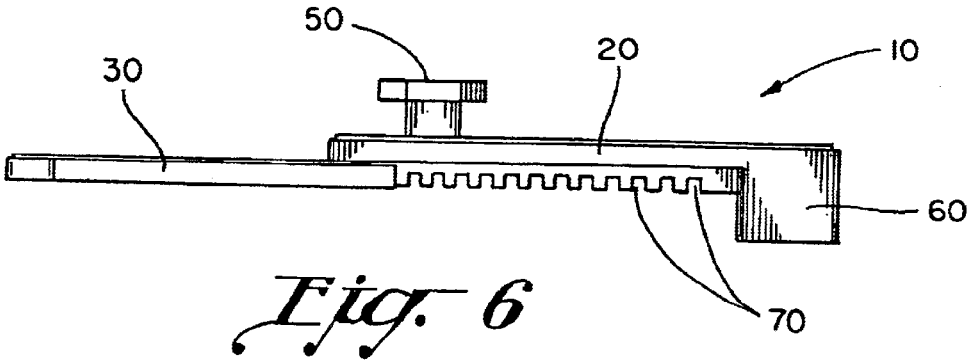
FIG. 6.
Figure 7:
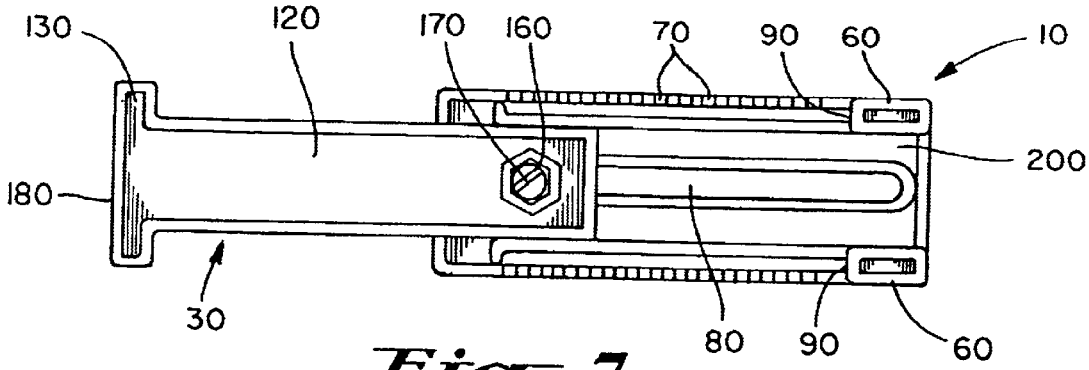
FIG. 7.

The threaded fastener 40 as shown in FIGS. 4 and 7 is preferably a 1 inch long slotted bolt with ¼×20 threads and a ⅜ inch six sided head. The shaft of the threaded fastener fits through the aperture 140 within the telescoping member 30 and the elongated slot 80 of the body 20 where the knob 50 is fastened onto the end of the fastener 40. The head 170 of the fastener 40 is retained within the retention wall 160 allowing the fastener 40 to remain stationary as the knob 50 is turned about the threads of the fastener 40.

Figure 2:
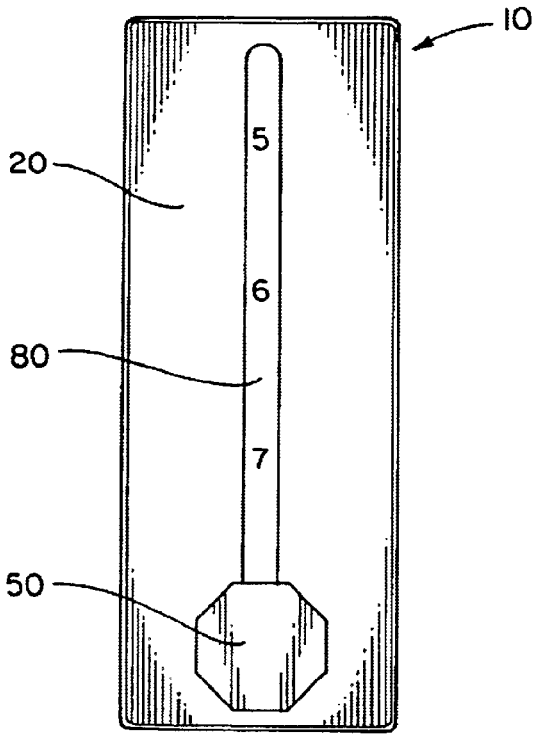
FIG. 2.
Figure 3:
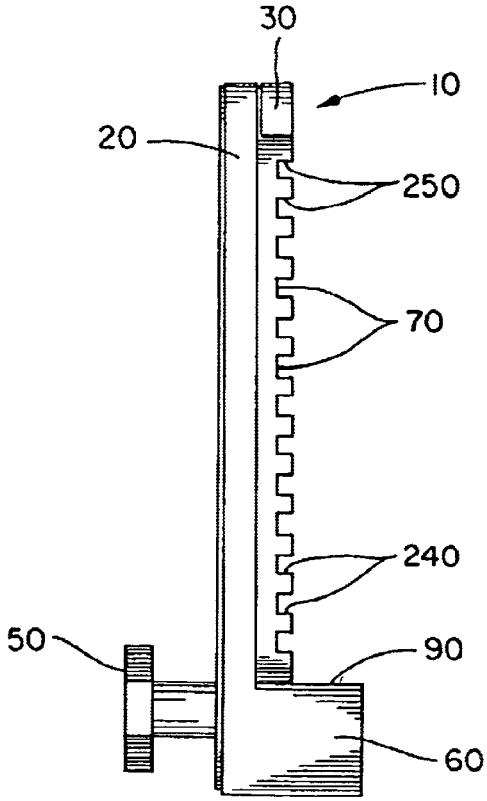
FIG. 3.

The knob 50 as shown in FIGS. 1–3 is preferably hexagon shaped to provide gripping surfaces 190, measures 1 inch across and is preferably made of a rigid plastic. The knob 50 may be loosened about the threaded fastener 40 to allow repositioning of the telescoping member 30 with relation to the body 20. The slot 80 in the body 20 allows the shaft of the threaded fastener 40 extending through the slot 80 to move within the slot 80 when telescoping member 30 is extended or retracted with relation to the body 20. When a user positions the telescoping member 30 to a desired position, the knob 50 can be tightened about the threaded fastener 40 thereby tightening the top face 190 of the telescoping member 30 to the bottom face 200 of the body 20 fixing the relationship between the telescoping member 30 and the body 20.

The instrument stops or guiding wells 70 as shown in FIGS. 1, 3, 4, and 6–8 are preferably ⅛ inch wide and are spaced 5/16 inch on center apart. The guiding wells 70, also referred to as measurement locating teeth, allow a user of the gauge 10 to place the tip 210 of a marking instrument 220 such as a pencil or pen into a well 70 at a measured distance from the front face 90 of the butt legs 60 as shown in FIG. 8. The user of the device 10 may then slide the device 10 along the edge of a work piece with the tip of the marking instrument 220 being guided by the guiding wells 70 making a mark 230 parallel to the edge of the work piece 100 as shown in FIG. 8. In the preferred embodiment shown through out the drawings, the guiding wells 70 are spaced such that placement of the tip 210 of a marking instrument 220 against the proximal wall 240 of a guiding well 70 will place the tip 210 of the marking instrument 220 at ¼ inch increments from the face 90 of the butt legs 60. Placement of the tip 210 of a marking instrument 220 against the distal wall 250 of a guiding well 70 will place the tip 210 of the marking instrument 220 at 118 inch increments from the face 90 of the butt legs 60.

Figure 10:
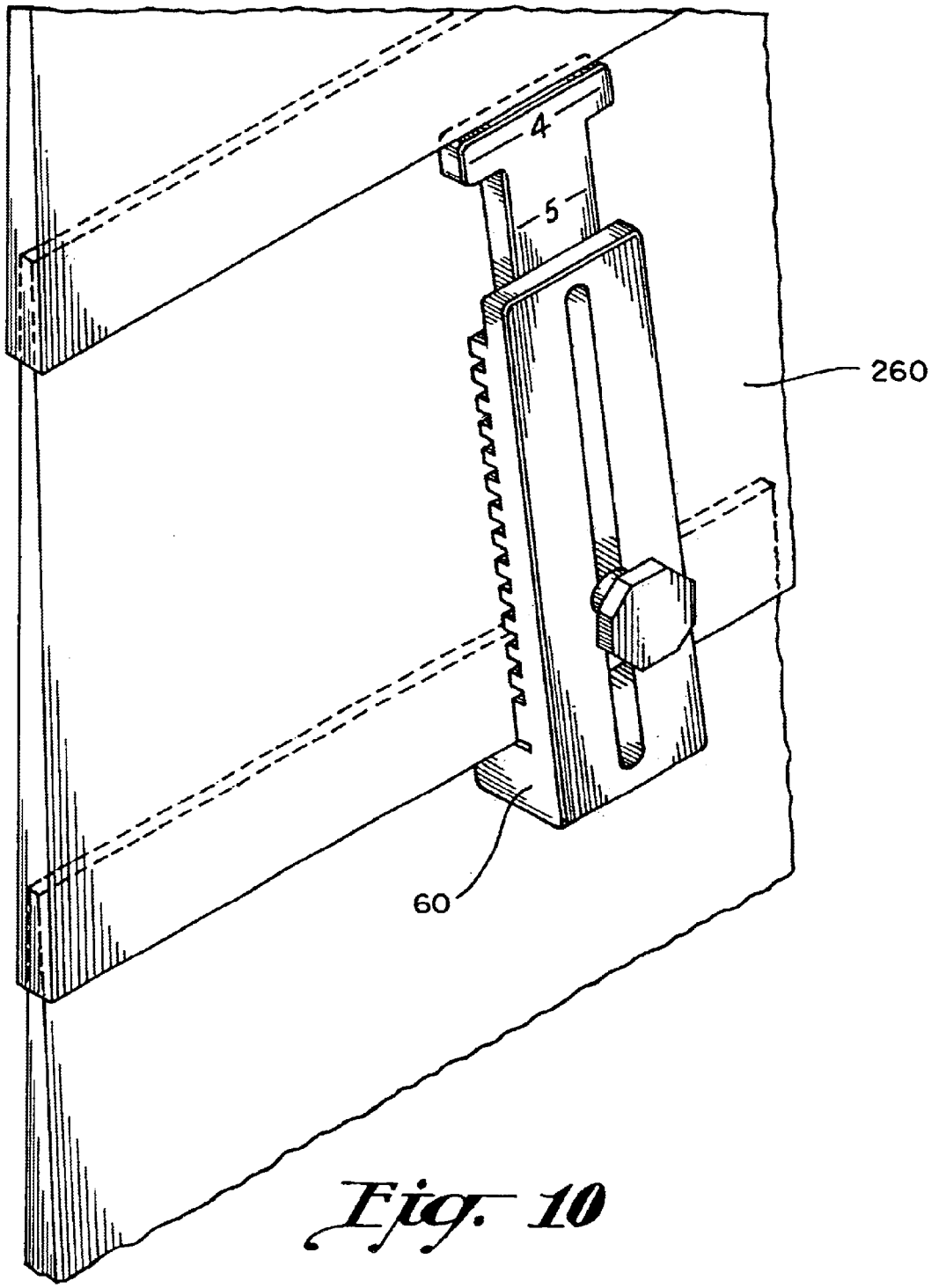
FIG. 10.

The gauge 10 can be used in a plurality of applications where making measured markings are needed such as in the installation of building siding as shown in FIG. 10. The butting legs 60 can be place against the lip of a course of siding 260 so that the measurements made with the device will be made making reference to the lip of the course. This is helpful in that the user can simultaneously measure and mark where the next course of siding has to be placed in relation to the previous course 260 of siding installed.

FIGS. 8 and 9 show how a marking instrument 220 is used with the gauge 10. FIG. 8 shows how the guiding wells 70 guide the tip 210 of the marking instrument 220 as the gauge 10 is slid along the edge 270 of the work piece 100. FIG. 9 show how the top edge 180 of the telescoping member 30 can be used as a guiding member for distance from the edge 270 of a work piece 100 that extend beyond the length of the body 20.

Although the invention has been described by reference to some embodiments it is not intended that the novel device be limited thereby, but that modifications thereof are intended to be included as falling within the broad scope and spirit of the foregoing disclosure, the following claims and the appended drawings.

I claim:

1. A hand held device for making measured markings on a work piece, the device comprising:

an elongated body having a bottom surface and a side surface;

at least one butting surface connected to the bottom surface of the body having a substantially flat front face perpendicular to the body sized and shaped to slidably butt against an edge of a work piece;

a plurality of guiding wells adjacent the side surface sized and shaped to receive a point of a marking instrument spaced at a predetermined distance from the front face of the butting surface, each guiding well having a proximal wall providing a first instrument stop for a first measurement and a distal wall providing a second instrument stop for a second measurement ⅛ inch from the first measurement allowing placement of instrument stops at ⅛ inch intervals;

at least one telescoping member having a top face parallel to the body and a substantially flat top edge providing guidance for a point of a marking instrument while the butting surface is slid along the edge of a work piece;

a plurality of reference markings on the top face of the telescoping member marking distance from the top edge of the telescoping member to the front face of the butting surface; and at least one fixing means adjustably fixing the relationship between the telescoping member and the body, the telescoping member extendable and retractable to distance shown by the reference markings.

2. The device of claim 1 further comprising an aperture through the body wherein a portion of the fixing means is moveable within the aperture.

3. The device of claim 2 wherein the guiding wells have width of about ⅛ inch and depth of at least ⅛ inch.

4. The device of claim 3 wherein center points of the guiding wells are spaced about 5⁄16 inch apart.

5. The device of claim 4 further comprising a second butting surface connected to the bottom surface of the body, the butting surface and the second butting surface coacting to slidably but against an edge of a work piece.

6. The device of claim 5 wherein the telescoping member is movable between the butting surface and the second butting surface.

7. In a hand held measuring gauge for making measured markings having an elongated body with an aperture there through, a telescoping member with an aperture there through in registry with the aperture of the elongated body, a fastener adjustably connecting the elongated body and the telescoping member through the apertures, a butting surface for indicating an edge of a work piece and a plurality of reference markings on the telescoping member for marking distance from a top edge of the telescoping member to the butting surface, the improvement comprising a plurality of guiding wells within a side surface of the elongated body providing dual instrument stops, each guiding well having a proximal wall providing a first instrument stop for a first measurement and a distal wall providing a second instrument stop for a second measurement ⅛ inch from the first measurement allowing placement of instrument stops at ⅛ inch intervals.

8. The hand held device of claim 7 wherein the guiding wells provide recesses within the side of the elongated body preventing marking instrument tips placed within the guiding wells from slipping out of the guiding wells during use.

9. A hand held measuring gauge for making measured markings on a face of a work piece, the gauge comprising:

an elongated body with an aperture there through;

a telescoping member adjacent the elongated body with an aperture there through in registry with the aperture of the elongated body;

a butting surface for indicating an edge of a work piece;

a fastener adjustably connecting the elongated body and the telescoping member through the apertures;

a plurality of reference markings on the telescoping member for marking distance from a top edge of the telescoping member to the butting surface;

a plurality of guiding wells within a side surface of the elongated body, each guiding well having a proximal wall providing a first instrument stop for a first measurement and a distal wall providing a second instrument stop for a measurement ⅛ inch from the first measurement.

10. The hand held device of claim 9 wherein the guiding wells provide recesses within the side of the elongated body allowing marking instrument tips placed within the guiding wells at an acute angle from the work piece from slipping out of the guiding wells during use.

* * * * *

UNITED STATES PATENT AND TRADEMARK OFFICE

CERTIFICATE OF CORRECTION

PATENT NO. : 6,836,969 B1
DATED : January 4, 2005
INVENTOR(S) : Randy N. Bates

It is certified that error appears in the above-identified patent and that said Letters Patent is hereby corrected as shown below:

Column 1,
Line 43, “id” should be -- is --

Column 2,
Line 63, delete “FIG. 1”;
Line 65, delete “FIG. 2”.

Column 3,
Line 1, delete “FIG. 3”;
Line 3, delete “FIG. 4”;
Line 5, delete “FIG. 5”;
Line 8, delete “FIG. 6”;
Line 11, delete “FIG. 7”;
Line 14, delete “FIG. 8”;
Line 16, delete “FIG. 9”;
Line 19, delete “FIG. 10”;

Column 4,
Line 54, “118” should be -- 1/18 --.

Column 6,
Line 2, “but” should be -- butt --.

Signed and Sealed this

Seventh Day of June, 2005

JON W. DUDAS
*Director of the United States Patent and Trademark Office*